United States Patent [19]

Rama et al.

[11] Patent Number: 4,460,103

[45] Date of Patent: Jul. 17, 1984

[54] COVER FOR DRINK CONTAINERS

[75] Inventors: Lord Rama; David Eccles, both of Rosendale, N.Y.

[73] Assignee: Alvex Development Corp., Carmel, N.Y.

[21] Appl. No.: 399,683

[22] Filed: Jul. 19, 1982

[51] Int. Cl.[3] ..... B65D 41/26; B65D 41/56

[52] U.S. Cl. ..... 220/254; 220/90.2; 220/90.4; 220/269; 229/7 R

[58] Field of Search ..... 220/90.2, 90.4, 254, 220/269; 229/7 R, 43

[56] References Cited

U.S. PATENT DOCUMENTS

| | | | |
|---|---|---|---|
| 3,843,037 | 10/1974 | Susuki et al. | 229/7 R |
| 3,994,411 | 11/1976 | Elfelt et al. | 229/7 R X |
| 4,077,538 | 3/1978 | Waterbury | 220/269 X |
| 4,202,459 | 5/1980 | DeParales et al. | 220/90.4 |
| 4,253,582 | 3/1981 | Shields | 220/269 |

*Primary Examiner*—Allan N. Shoap

*Attorney, Agent, or Firm*—Kenneth E. Macklin

[57] ABSTRACT

A cover for a drink container, preferably a disposable container, having a rim, said cover made from a resilient non-metallic material, preferably a thermoplastic polymer, and comprising a peripheral rim section adapted to fit snugly over the rim of the container and a resilient cover panel extending between the confines of said rim section to cover the container, said cover panel having a weakening line defining a flap and a hinge for the flap, said flap having a raised pull-tab which may be grasped and pulled so that the weakening line may be torn and the flap opened by folding at its hinge section, said cover panel also having a depressed well section which is of such size and shape and so positioned that when the flap is folded over on its hinge, the pull-tab may be nested in the well and the flap thereby retained in an open position.

7 Claims, 8 Drawing Figures

COVER FOR DRINK CONTAINERS

The invention is concerned with covers for drink containers, such as coffee cups, and, more particularly, to covers which aid in temperature retention, prevent spillage of liquid contents from the containers, and yet permit drinking from the container without removing the cover.

BACKGROUND OF THE INVENTION

Non-spill covers for drink containers are desirable for many applications. Typically, such covers are useful on styrofoam cups full of hot coffee, tea, chocolate or soup to be drunk in a moving vehicle or while the drinker is walking or working. However, non-spill covers previously available or proposed are unsuitable in one or more ways and are of complex design and therefore too expensive for disposable use, or are arranged so that ingredients, such as sugar and cream, cannot be conveniently added to the container and stirred without removing the cover.

DESCRIPTION OF THE PRIOR ART

Among the proposals of the prior art are those disclosed in the following patents.

U.S. Pat. No. 3,927,794 shows a lid having a hinged U-shaped tab with a raised block on the tab which allows the tab to be separated from the lid when the block is depressed. The block also serves to lock the tab in the depressed position allowing the opening to remain accessible for pouring or drinking. The opening so formed is too small, obstructed by the tab, and apparently cannot readily be reclosed with the tab.

U.S. Pat. No. 4,081,103 describes a cover for a drinking container which has a hinged flap 30 which may be depressed by finger pressure on button 50 so that the user may drink the contents. When the pressure is removed, the flap returns to its initial position to close the opening.

U.S. Pat. No. 4,138,033 shows a lid with an opening. The lid has a flap which is folded 180° so that it lies underneath the lid and closes the opening. The flap has a ball which snaps into a socket in the lid. In use, the upper lip of the drinker depresses the flap when the lip engages a raised projection on the flap which protrudes through the opening. When lip pressure is removed, the flap automatically closes the opening. The lid would apparently be too expensive to manufacture and therefore would not be competitive in price.

U.S. Pat. No. 4,184,604 shows a lid which again has a raised hinged flap, which is depressed by the drinker's upper lip in order to expose the opening and allow the drinking of a cup's contents.

U.S. Pat. No. 4,190,174 also shows a lid with a raised hinged flap which is depressed by the upper lip of the drinker. The lid has a two-layer construction.

The foregoing patents all describe the use of sections of a cover which are depressed into the drink cup in order to drink the contents of the cup. Such an arrangement is awkward to use and makes it difficult to add other ingredients such as sugar and cream to the cup's contents and difficult to stir the contents. Also, such a flap which is depressed into the cup's contents allows any dust or debris on the cover (which may have accumulated during its storage) to fall into the contents.

U.S. Pat. No. 4,141,462 shows a lid with a somewhat elliptical opening located at its rim. The opening has a covering which is adhered to the area of the lid surrounding the opening. A tab on the covering is gripped and pulled to remove the covering and expose the opening in the lid. Such a covering is not readily replaceable. Because of the cover's design, the cover would not be expected to be competitive in price.

U.S. Pat. Nos. 2,689,664; 3,977,559 and 3,994,411 generally describe radial segments of a cover which are hinged to open from the rim of the cover toward the center of the cover. The integrity of the rim of the cover is thereby destroyed; therefore, the total gripping power of the cover on the rim of the container is lessened; and consequently the cover may be more readily dislodged. The first two of the three patents show no means for maintaining the radial segments in an open position for easy drinking. The covers of the last two of the three patents are more costly to produce and transport because of the tabs. The covers of all three patents are susceptible to spilling remaining contents of a cup if, as the cup is emptied and therefore lighter in weight, it tips over. The reason for the susceptibility is that the radial openings leave at least a section of the rim of the cup un-dammed so that remaining contents can spill out. Spilled tea, coffee and cola drinks will leave lasting stains on clothing and carpets.

The present invention overcomes many of the deficiencies of the prior art.

SUMMARY OF THE INVENTION

It is an object of the present invention to provide a cover for a drink container, which cover has a flap which may be opened up and maintained open for drinking without removing the cover from the container.

It is also an object of the present invention to provide such a flap which may be closed down after drinking to inhibit or prevent spillage and to maintain the contents of the container at their temperature.

Briefly, the present invention comprises a cover for a drink container (preferably a disposable container) having a rim, said cover being made from a resilient nonmetallic material, preferably a thermoplastic polymer, and comprising a peripheral rim section adapted to fit snugly over the rim of the container and a resilient cover panel extending between the confines of said rim section to cover the container, said cover panel having a weakening line defining a flap and a hinge for the flap, said flap having a raised pull-tab which may be grasped and pulled so that the weakening line may be torn and the flap opened by folding at its hinge section, said cover panel also having a depressed well section which is of such size and shape and so positioned that when the flap is folded over on its hinge, the pull-tab may be nested in the well and the flap thereby retained in an open position.

DESCRIPTION OF THE PREFERRED EMBODIMENTS

Figure 1:
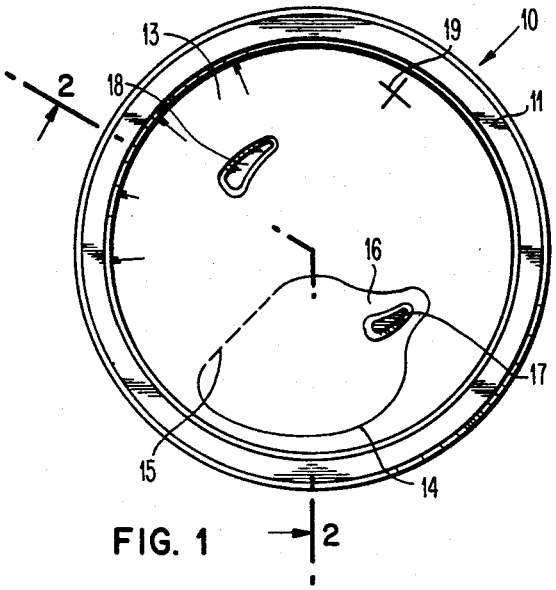
FIG. 1 is a top plan view of one preferred embodiment of the cover of the invention.

In FIGS. 1 to 4, a preferred embodiment of the cover 10 of the present invention is shown. Cover 10 has a rim 11. Rim 11 on its underside has an annular groove 12 which is sized so that it grips the rim of the drink container 50. Extending between the confines of the rim 11 is cover panel 13. Panel 13 has a flap area 16, which is defined by continuous weakening or "score" line 14 and by discontinuous weakening or "score" line 15. Flap area 16 has a raised pull-tab 17, which may be grasped and pulled up and to the left in the configuration depicted, thereby causing the flap 16 to be freed by tearing along score line 14. Then, by pulling tab 17 to the left in the depicted configuration, the flap 16 may be folded over hinge 15 so that pull-tab 17 may be nested in well 18, which is sized and shaped and so positioned on panel 13 as to receive pull-tab 17 in a press fit so that flap 16 may be kept open and allow easy drinking of contents 30 from cup 50. Cross-shaped score-line 19 may be used to hold a straw, which may be pushed through 19 so that the contents of the container may be drunk.

The cover configuration shown in FIG. 1 may be laterally reversed so that the flap 16 opens toward the right instead of toward the left.

The pull-open flap 16 is outlined by a continuously scored line 14 except for the hinge 15, which is intermittently scored so as to ordinarily prevent tearing, if that is desired, thereby avoiding litter.

Figure 5A:
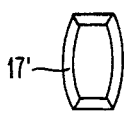
FIGS. 5*a* and *b* are respectively top plan views of a preferred pull tab on the flap and a retaining well in the cover for it.
Figure 5B:
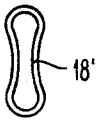

Preferred modifications of pull-tab 17 and well 18 of FIG. 1 are shown as pull-tab 17' and well 18' in FIGS. 5*a* and *b*. When pull-tab 17' is pressed into well 18', the narrow mid-section of the latter pinches the wider mid-section of the former, holding it and thereby its flap 16 in the open position.

Figure 2:
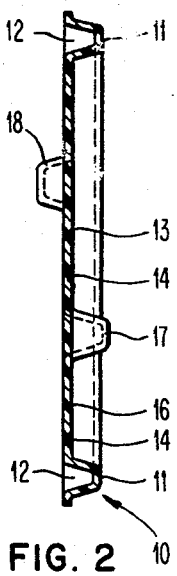
FIG. 2 is an elevational view taken along the section 2—2 indicated by the bold broken line in FIG. 1.
Figure 3:
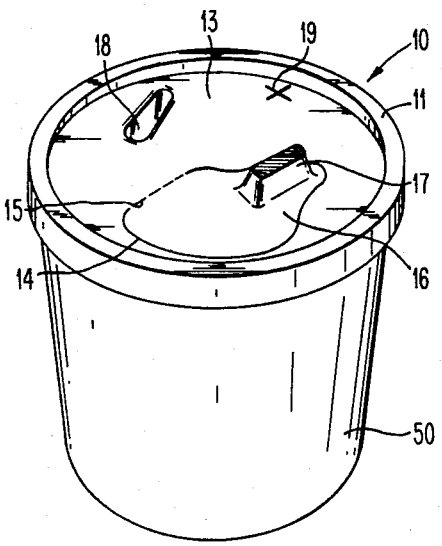
FIG. 3 is a perspective view of the cover shown in FIG. 1, on a drink container, such as a styrofoam coffee cup.
Figure 6A:
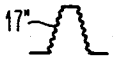
FIGS. 6*a* and *b* are respectively cross-sectional views of another preferred pull tab on the flap and the retaining well in the cover for it.
Figure 6B:
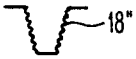

Other preferred modifications of pull-tab 17 and well 18 of FIG. 2 are shown as pull-tab 17" and well 18" in FIGS. 6*a* and *b*. When pull-tab 17" is pressed into well 18", the the ridges of the latter engage with the ridges of the former, holding it and thereby its flap 16 in the open position.

Figure 4:
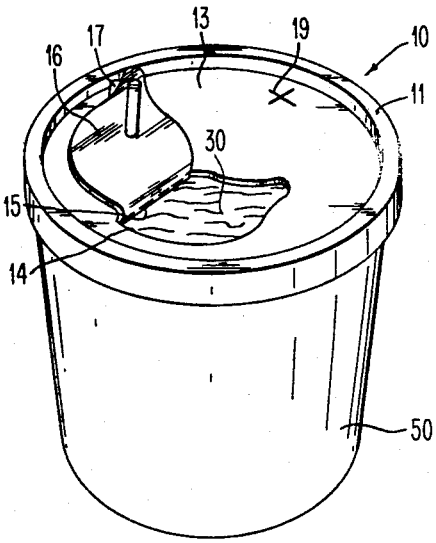
FIG. 4 is a perspective view similar to that in FIG. 3, but the drinking flap is shown approximately three quarters open.

With the cover 10 in place on a container 50 containing liquid 30, the user may drink from the container without removing the cover in one of the following ways:

(a) The cup 50 may be held in the left hand and the flap 16 held open with the left thumb, e.g., in the position shown in FIG. 4. The flap 16 may be reclosed whenever desired to prevent spillage and to maintain the contents at their temperature.

(b) The flap 16 may be held open by pressing its pull-tab 17 into well 18.

After drinking, one may return the flap 16 to its former position to cover the contents 30 in container 50 by so pressing it in place that the edges of the flap 16 catch the corresponding edges of cover panel 13. The latter edges may be slightly overlapped by bumps or projections embossed at the edges of the cover panel 13 during forming. The bumps or projections would serve to hold the flap closed after use.

Alternatively, one may completely tear off flap 16 by pulling and twisting so as to tear it along hinge 15.

Although a number of conventional processes and materials may be used to form the cover 10 of the invention, the cover 10 is preferably formed as a one-piece unit from a thin sheet of a thermoplastic polymeric material, such as high impact polystyrene, using standard vacuum-forming techniques. The polymeric material should provide a relatively rigid structure and yet have a sufficient resiliency. The score lines 14 and 15 for the flap 16 and hinge 15 in the cover can be made by partially cutting or embossing the outline of the flap 16 in the cover 10 after the cover has been formed. One process for the scoring of the flap section 16 is the continuous reduction, or "scoring," of the outline of the flap 16 except for the hinge 15 of the flap 16, which may be formed by intermittently reducing, or "scoring," the outline of the flap 16 at its hinge side 15. The material of the cover 10 may be about 0.015" thick before forming, about 0.012" thick after forming, and the reduced, or "scored," lines may be about 0.006" thick ±0.002". Preferably, the reduction or "scoring" is accomplished at the "clinking" or blanking stage, i.e., the manufacturing stage after forming when the sheet of lid impressions is transferred to a blanking or "clinking" die press for separation and removal of scrap or "clink."

As seen above, the covers of this invention may be inexpensively manufactured in a two-step process from one piece of material. The covers may be nested one on top of another to conserve space for storage and transport. The drinking flap on the cover may be opened readily with one hand. Physically impared individuals may open the drinking flap by grasping its pull-tab with their teeth. The covers of this invention are superb universal pull-to-open take-out beverage container lids. The cover's ergonomically curved openings, which are exposed when the flap is opened, are comfortable to drink from because they have no angular edges. It is possible to add ingredients to a cup's contents and stir the contents through the opening. One may drink a soup through the opening and then spoon out noodles etc. through the opening. A straw may be inserted through the opening or through other means provided on the cover.

Although a cover 10 of the invention has been described for use with a circular disposable cup 50, it should be understood that it can be adapted for use on ordinary plastic or glass drinking containers used for a variety of purposes and having a variety of configurations.

What is claimed is:

1. A cover for a drink container having a rim, said cover made from a resilient non-metallic material and comprising a continuous, uninterrupted peripheral rim section adapted to fit snugly over the rim of the container and a resilient cover panel extending between the confines of said rim section to cover the container, said cover panel having a weakening line within the confines of said cover panel and defining a flap and a hinge for the flap, said flap having a raised pull-tab which may be grasped and pulled so that part of the weakening line may be torn and the flap opened by folding at its hinge, said hinge being positioned in an essentially radial direction relative to the center of said resilient cover panel so that one of the ends of said hinge is adjacent the opening so formed at the part thereof nearest said peripheral rim section, said cover panel also having a depressed well section which is of such size and shape and so positioned that when the flap is folded over on its hinge, the pull-tab may be nested in the well and the flap thereby retained in an open position.

2. A cover as claimed in claim 1 wherein the cover is made from a thermoplastic polymer.

3. A cover as claimed in claim 1 wherein the cover is made from high-impact polystyrene.

4. A cover as claimed in claim 1 wherein the flap is so shaped that when opened it exposes a curve-sided opening.

5. A cover as claimed in claim 1 wherein the flap is hinged on its left side as viewed by the drinker.

6. A cover for a drink container having a rim, said cover made from a resilient non-metallic material and comprising a peripheral rim section adapted to fit snugly over the rim of the container and a resilient cover panel extending between the confines of said rim section to cover the container, said cover panel having a weakening line defining a flap and a hinge for the flap, said flap having a raised pull-tab which may be grasped and pulled so that part of the weakening line may be torn and the flap opened by folding at its hinge, said cover panel also having a depressed well section which is of such size and shape and so positioned that when the flap is folded over on its hinge, the pull-tab may be nested in the well and the flap thereby retained in an open position, said raised pull-tab on the flap having a middle section wider than its end sections, and said well in the cover panel having end sections wider than its middle section, the middle section of said well being narrower than the middle section of the pull-tab, so that when the flap is opened and hinged back with the raised pull-tab nested in the well, the narrow midsection of the latter can pinch and hold the wider midsection of the former, thereby holding the flap open by friction fit.

7. A cover for a drink container having a rim, said cover made from a resilient non-metallic material and comprising a peripheral rim section adapted to fit snugly over the rim of the container and a resilient cover panel extending between the confines of said rim section to cover the container, said cover panel having a weakening line defining a flap and a hinge for the flap, said flap having a raised pull-tab which may be grasped and pulled so that part of the weakening line may be torn and the flap opened by folding at its hinge, said cover panel also having a depressed well section which is of such size and shape and so positioned that when the flap is folded over on its hinge, the pull tab may be nested in the well and the flap thereby retained in an open position, said raised pull-tab on the flap having ridges on its surface, and said well in the cover panel having ridges which engage and hold the ridges on the pull-tab when the flap is opened back and the pull-tab is pushed into the well.

* * * * *